US006732434B2

(12) United States Patent
Luo et al.

(10) Patent No.: US 6,732,434 B2
(45) Date of Patent: May 11, 2004

(54) PROCESS FOR FORMING ALUMINUM HYDROFORMS

(75) Inventors: Aihua A. Luo, Troy, MN (US); Anil K. Sachdev, Rochester Hills, MI (US)

(73) Assignee: General Motors Corporation, Detroit, MI (US)

( * ) Notice: Subject to any disclaimer, the term of this patent is extended or adjusted under 35 U.S.C. 154(b) by 138 days.

(21) Appl. No.: 10/122,811

(22) Filed: Apr. 15, 2002

(65) Prior Publication Data

US 2003/0192160 A1 Oct. 16, 2003

(51) Int. Cl.[7] ..... B21D 53/88

(52) U.S. Cl. ..... 29/897.2; 29/527.6; 29/527.7; 29/33 D

(58) Field of Search ..... 219/603, 607, 219/612; 164/481, 431, 432, 476, 417; 29/890.053, 897, 897.2, 897.3, 897.35, 415, 417, 421.1, 505, 525.14, 527.5, 527.6, 527.7, 33 D, 33 Q, 33 S, 33 T, 781, 819, 787, 795

(56) References Cited

U.S. PATENT DOCUMENTS

| | | | | | |
|---|---|---|---|---|---|
| 4,569,386 | A | * | 2/1986 | Mine | 164/476 |
| 4,911,221 | A | * | 3/1990 | Jordan et al. | 164/155.5 |
| 5,133,402 | A | * | 7/1992 | Ross | 164/431 |
| 5,379,829 | A | * | 1/1995 | Bricmont | 164/476 |
| 5,862,582 | A | * | 1/1999 | Sun | 29/527.7 |
| 5,894,879 | A | * | 4/1999 | Wyatt-Mair et al. | 164/476 |
| 6,457,227 | B1 | * | 10/2002 | Nijveld et al. | 29/527.7 |

* cited by examiner

*Primary Examiner*—Gregory Vidovich
*Assistant Examiner*—T. Nguyen
(74) *Attorney, Agent, or Firm*—Kathryn A. Marra

(57) ABSTRACT

The present invention provides a process for forming aluminum alloy hydroformed structures for automotive vehicles at low cost. The process continuously casts molten aluminum alloy into aluminum alloy strip material preferably followed by continuously warm rolling the strip material into aluminum alloy sheet material. The sheet material is formed into one or more aluminum alloy tubes and the tubes are hydroformed into the desired automotive vehicle structure.

11 Claims, 3 Drawing Sheets

PROCESS FOR FORMING ALUMINUM HYDROFORMS

TECHNICAL FIELD

The present invention relates to a process for forming low cost aluminum alloy hydroforms, particularly low cost hydroformed tubes suitable for assembly as automotive vehicle structures.

BACKGROUND OF THE INVENTION

It is known to deform steel members such as steel tubes for forming automotive vehicle structures, by the process of hydroforming. It is also known that automotive vehicle structures formed of hydroformed steel members can provide advantages over vehicle structures formed according to alternative techniques, such as lowering vehicle weight, allowing component consolidation, improving vehicle performance and the like. Recently, there has been interest in using aluminum alloys for hydroformed automotive vehicle structures, particularly given that aluminum alloys provide an attractive high strength to weight alternative to hydroformed steel and because aluminum alloys are typically resistant to the corrosive environments also to which automotive vehicles are subjected. However, in view of metal forming needs quite often unique to aluminum alloys, the hydroforming of aluminum alloy components has tended to be expensive, labor intensive or both. Thus, there is a need for improved techniques for forming hydroformed aluminum vehicle structures, particularly hydroformed aluminum tubular structures wherein the techniques are more economical, less labor intensive or both.

SUMMARY OF THE INVENTION

The present invention meets these needs by providing an improved process for forming hydroformed aluminum members, with particular utility in the formation of tubular vehicle structures. According to the process, there is provided a molten aluminum alloy having no greater than about 6 weight percent magnesium. The molten aluminum alloy is dispensed substantially continuously to a twin belt continuous caster at a temperature of about 600° C. to about 800° C. Then the molten aluminum alloy is continuously cast with the twin belt caster into aluminum alloy strip material wherein the strip material has a gage thickness of about 10 millimeters to about 16 millimeters. Preferably, the strip material exits the caster at a temperature of about 400° C. to about 600° C. Thereafter, the aluminum alloy strip material is thinned to form aluminum alloy sheet material to a desired gage thickness of from about 2 millimeters to about 6 millimeters. The sheet material is formed into one or more aluminum alloy tubes while the sheet material remains at the desired gage thickness. The tubes are then hydroformed into the tubular automotive vehicle structure. Preferably, the tubular structure has at least one hydroformed contour and is a member of a frame of an automotive vehicle.

BRIEF DESCRIPTION OF THE DRAWINGS

These and other aspects and advantages of the present invention will become apparent upon reading the following detailed description in combination with the accompanying drawings, in which.

DETAILED DESCRIPTION OF THE PREFERRED EMBODIMENT

Figure 1:
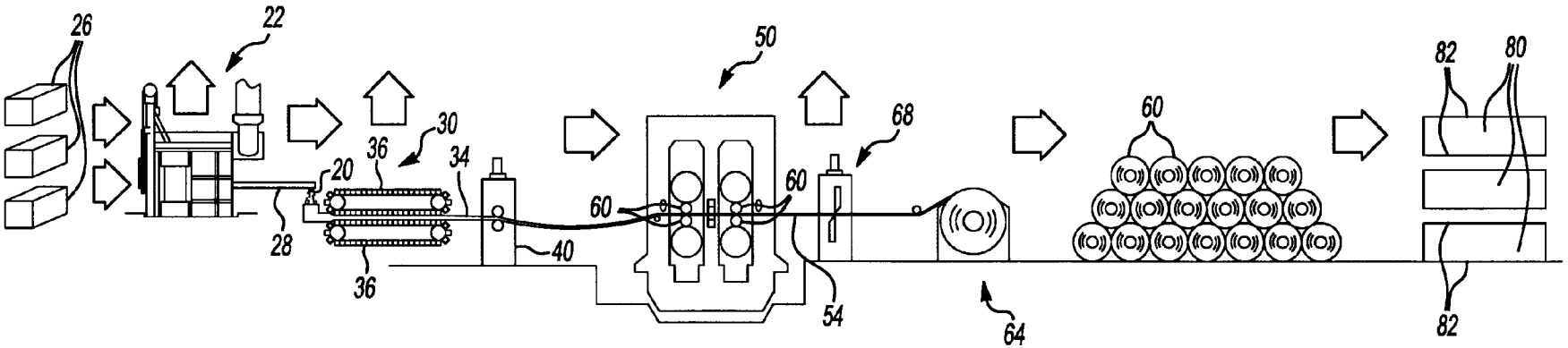
FIG. 1 is a schematic of process steps for forming hydroformed automotive vehicle structures.
Figure 2:
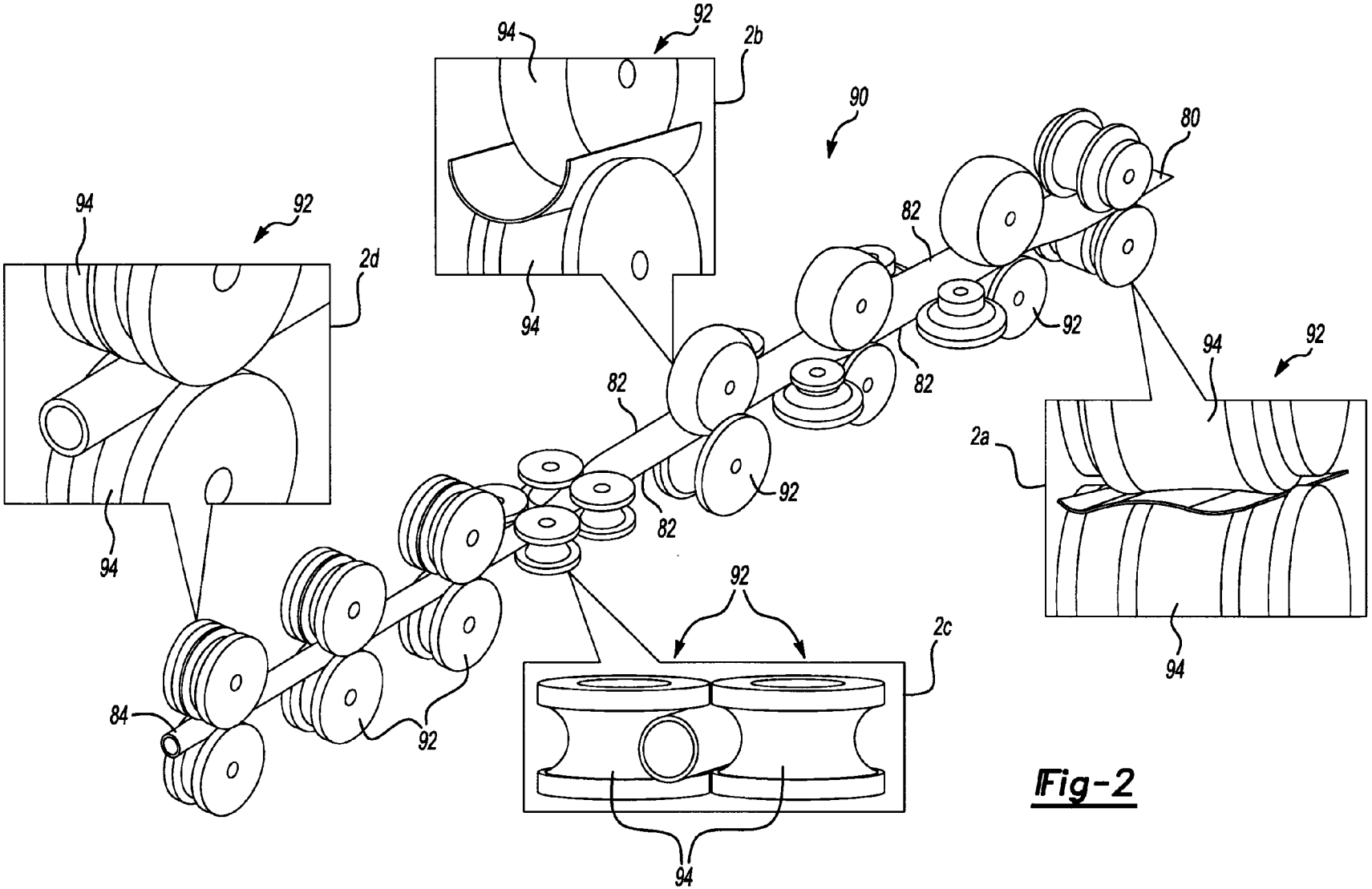
FIG. 2 is a perspective schematic of process steps, including enlarged frames 2*a*–2*d* corresponding to particular aspects of the process.
Figure 3:
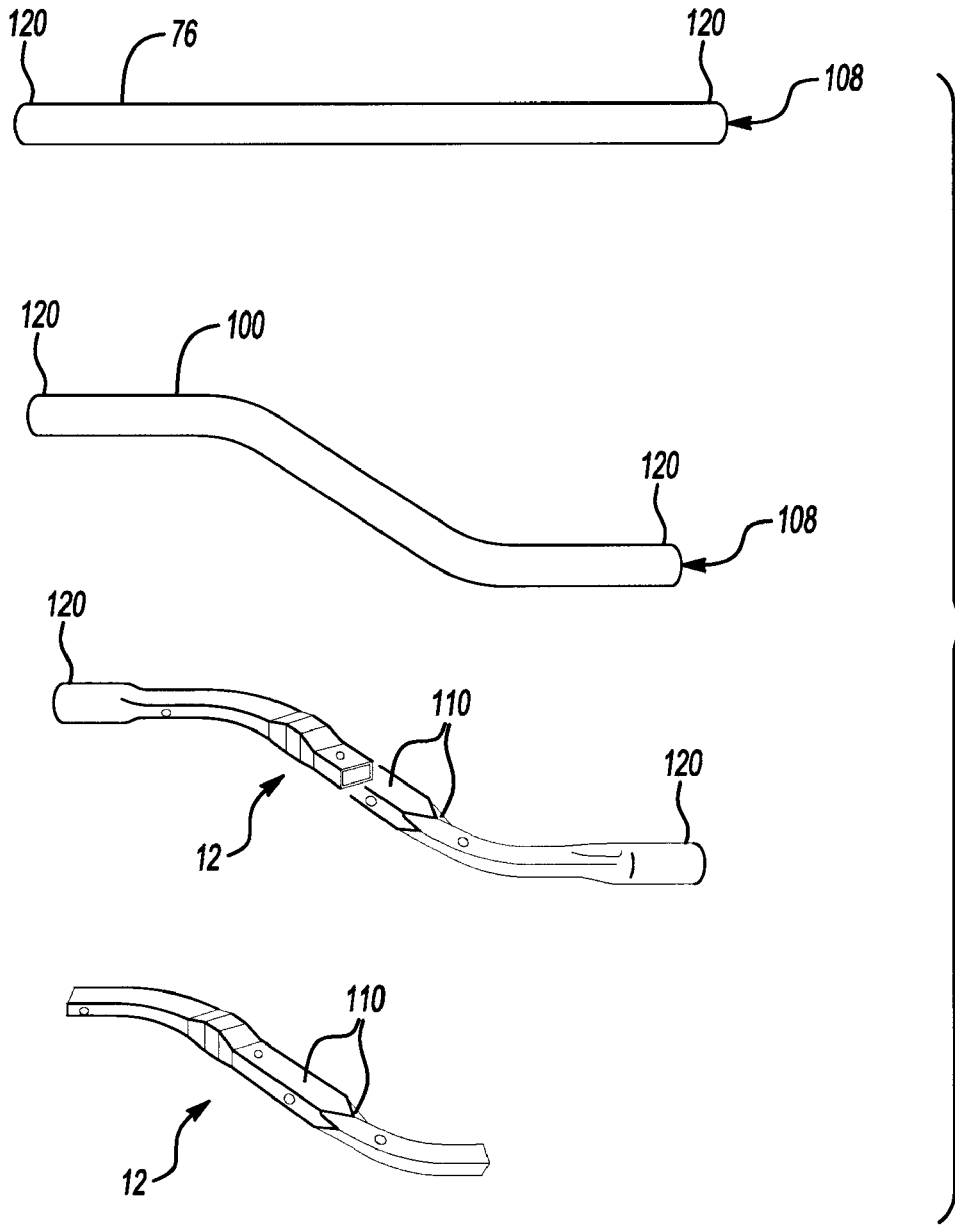
FIG. 3 illustrates a sample work piece at various stages of the process of the present invention.

Referring to FIGS. 1–3, there is illustrated a preferred process for forming aluminum alloy hydroforms 12 (e.g., hydroformed aluminum alloy tubular structures) in accordance with the present invention. Preferably, the hydroforms 12 are suitable for automotive vehicle applications.

Referring specifically to FIG. 1, an aluminum alloy 20 is melted by a furnace system 22. Preferably, the ingredients of the alloy 20 are charged to the furnace system 22 as pre-formed aluminum alloy ingots 26, each containing one or more alloy ingredient in a preselected concentration.

A preferred resulting alloy includes Aluminum, Silicon and at least one other ingredient selected from the group consisting of: iron (Fe), copper (Cu), manganese (Mn), magnesium (Mg), chromium (Cr), zinc (Zn), nickel (Ni), titanium (Ti) and mixtures thereof. Preferably, the alloy includes about 0.05 to about 2.0 weight percent silicon, up to about 0.60 weight percent iron, about 0.01 to about 4.0 weight percent copper, up to about 1.0 weight percent manganese, about 0.10 to about 6.0 weight percent magnesium, up to about 0.50 weight percent chromium and about 0.10 to about 6.0 weight percent zinc. In a highly preferred embodiment, the resulting alloy is aluminum AA5754-CC and includes approximately 0.10 weight percent silicon, 0.24 weight percent iron, 0.028 weight percent copper, 0.32 weight percent manganese, 2.85 weight percent magnesium and 0.011 weight percent chromium.

As shown in FIG. 1, one preferred furnace system 22 is equipped with a dispenser 28, which dispenses the aluminum alloy 20 to a continuous caster 30 in a substantially continuous manner. Preferably, the molten alloy 20 is dispensed at a temperature of about 600° C. to about 800° C., more preferably about 650° C. to about 700° C. and most preferably at about 680° C.

The caster 30 receives the molten aluminum alloy 20 from the furnace system 22 and continuously casts the molten aluminum alloy 20 into aluminum alloy strip material 34. Preferably, the caster 30 is a plural-belt caster (e.g. a twin-belt caster with a pair of opposing movable surfaces such as belts 36) that continuously advances the molten aluminum alloy 20 as it solidifies to form an elongate aluminum alloy form, such as a strip material 34. The twin belt machine 30 is preferably configured to form the strip material 34 to have a gage thickness between about 8 to about 20 millimeters and more preferably between about 10 to about 16 millimeters and most preferably about 14 millimeters. The caster 30 is also adapted so that the width of the strip material 34 is typically between about 10 and 100 inches; in one preferred embodiment, the width is about 58 inches.

The components of the caster are maintained at a suitable temperature and/or the rate of strip advancement is such that the strip material 34 exits the caster 30 at a temperature between about 400° C. and 600° C. and more preferably at a temperature of about 500° C. Optionally, the strip material 34 may be smoothed between opposing rollers in a pinch roller 40 after exiting the caster 30.

As shown in FIG. 1, the strip material 34 is continuously fed from the caster 30 to a hot or warm thinning system 50 such as a hot roll stand, a warm tandem mill, a twin roll system or the like. The thinning system 50 thins the strip material 34 into aluminum alloy sheet material 54 of a desired gage thickness. Preferably, the rolling system 50 includes two or more pairs of opposing rollers 60 that compress the strip material 34 continuously into the sheet material 54 as the strip material 34 is advanced through the rollers 60.

Upon exiting the thinning system 50, the desired gage thickness of the sheet material 54 is about 1 to about 8 millimeters, more preferably about 2 to about 6 millimeters and most preferably about 4 millimeters. Moreover, the rate of strip advancement or the temperature or other controllable condition of the thinning system is such that upon exiting the thinning system 50, the sheet material 54 is preferably at a temperature between about 275° C. and about 365° C., more preferably between about 300° C. and 330° C. and most preferably at about 315° C.

Optionally, the sheet material 54 exiting the rolling system 50 is rolled into coils 60 with a winder 64. Once a particular coil 60 is of a desired size, the sheet material 54 is cut with a shear machine 68 or other device and another coil 60 is then rolled. Rolling the sheet material 54 into coils 60 typically eases storage and transportation of the sheet material 54.

Thereafter, the sheet material 54 is formed into a plurality of tubes 76, an example of which is shown in FIG. 3. For forming the tubes 76, referring back to FIG. 1, the sheet material 54 is cut into elongated aluminum alloy strips 80 using a saw (not shown) or alternative devices. As shown, each of the strips 80 includes a pair of opposing side edges 82 extending with the elongation of the strips 80. It should be noted that the sheet material 54 could be directly formed as the elongated strips 80, however, formation of the sheet material 54 followed by cutting the sheet material 54 into strips 80 is typically more economical.

Referring now to FIG. 2, the strips 80 are formed (e.g., roll formed) into a tubular configuration 84 in a tube rolling mill 90. The mill 90 includes a plurality of shaping rollers 92 having peripheral surfaces 94 that are contoured (e.g., concave, convex or a combination thereof). As the strips 80 are fed to and advanced through the rolling mill 90, the strips 80 are bent and rolled into the tubular configuration 84 by the peripheral surfaces 94. Optionally, the shaping rollers 92 may be heated for assisting in rolling the strips 80. Preferably, the radius of curvature of the roller surface varies among the rollers, with downstream rollers having a tighter radius.

As the strips 80 exit the rolling mill 90, the opposing sides edges 82 are preferably directly adjacent to each other. The side edges 82 are then welded together for maintaining the tubular configuration 84. The side edges 82 are preferably induction welded together by heating the edges 82 to a temperature near the melting temperature of the aluminum alloy followed by applying pressure urging the edges 82 together for attachment.

Cooling and sizing rolls may be used to further process and shape the strips 80 while in the tubular configuration 84. The outer diameter of the tubular configuration 84, and therefore the outer diameter of the resulting tubes 76, is preferably between about 1 and about 12 inches, more preferably between about 2 and about 8 inches and is most preferably between about 2 and about 6 inches (e.g., about 4 inches).

The strips 80 typically have a length substantially longer than desired for the tubes 76 of FIG. 3. Thus, the strips 80 may be cut while in the tubular configuration 84 or prior to forming the tubular configuration 84 to a desired length of the tubes 76. In a preferred embodiment, the tubes 76 are cut to have a length of about 2 to about 20 feet long, more preferably about 4 to about 18 feet long and most preferably between about 10 and about 16 feet long.

Prior to hydroforming, preferably the tubes 76 are annealed. For annealing, the temperature of the tubes 76 is elevated to from about 280° C. to about 400° C. followed by cooling at an ambient temperature between about 0° C. to about 80° C. According to a highly preferred embodiment, the tubes 76 are annealed by elevating the temperature of the tubes 76 to about 325° C. for a time period of about 30 minutes following by cooling at about room temperature (e.g. about 25° C.) thereby minimizing grain growth during recrystallization.

Continuing to refer to FIG. 3, the tubes 76 are hydroformed into tubular automotive vehicle structures 12, which have various hydroformed contours 110. Advantageously, the tubes 76 may be hydroformed at the same gage thickness at which the sheet material 54 is supplied after exiting the thinning system 50 thereby lowering material processing costs, which would be incurred if additional thinning steps were required before thinning by hydroforming. Alternatively, however, it is contemplated that the gage thickness of the sheet material 54 may be further thinned if desired, before hydroforming.

Prior to hydroforming, the tubes 76 are initially deformed (e.g., bent) to a pre-hydroforming configuration 100 having the general shape of the desired resulting vehicle structure 12. Various bending processes may be utilized such as rotary draw bending or the like. Preferably, during bending, removable cores, plugs or other support members (not shown) are placed inside the tubes 76 at the expected bend location for contacting an inner surface 108 of the tube 76 to support the tube against undesired deformation such as kinking or other wall collapse that may occur during bending.

For hydroforming, opposing ends 120 of the tubes 76 are sealed shut and the tubes 76 are placed into a cavity of a hydroforming die (not shown). The tubes 76 are filled with a liquid (e.g., water) that pressurizes an interior portion of the tube 76 such that the tube 76 elastically deforms to fill the cavity of the dies thereby forming the hydroformed contours 110 of the vehicle structure 12. Preferably, the pressure induced within the interior portion of the tube 76 is between about 1000 psi and about 30,000 psi and more preferably between about 2000 psi and about 10,000 psi. Optionally, the ends 120 of the tube 76 may be removed (e.g., sawed off) to form the automotive vehicle structure 12 into the desired configuration.

It should be recognized that the process of FIGS. 1–3 may be used to form a variety of automotive structures, such as pillars, side rails, bumpers, roof bows, cross members, brackets, tunnel and lock pillar outers, suspension attachments, hinge pillar brackets, frame members, body members and the like. Advantageously, automotive vehicle components formed fully or partially of the aluminum alloys described herein can reduce the weight of the components at least 20% and more preferably at least 30% as opposed to, for example, steel. Moreover, the components may exhibit substantially the same strength as a heavier steel frame.

Although, the preferred process 10 of the present invention is used for forming tubular automotive vehicle structures 12, it is contemplated that the automotive structures may be hydroformed to include hydroform contours on members of other configurations such as generally square, rectangular, polygonal or the like.

Additionally, it is contemplated that, in alternative embodiments, the sheet material 54 may be cold rolled to a thinner gage. Advantageously, however, automotive structures such as the hydroformed tubular structure 10 of FIG. 3 may be formed according to the process of the present invention without the added expense and energy of cold rolling. It is further contemplated that the caster 30 may directly cast the strip material 34 to the desired gage (e.g., 4 millimeters thick) of the hydroformed tube without having to subsequently thin the strip material 34 in the thinning system 50.

It should be understood that the invention is not limited to the exact embodiment or construction which has been illustrated and described but that various changes may be made without departing from the spirit and the scope of the invention.

What is claimed is:

1. A process of forming a tubular aluminum alloy automotive vehicle structure, comprising the steps of:

(a) providing a molten aluminum alloy having no greater than about 6 weight percent magnesium;

(b) dispensing the molten aluminum alloy substantially continuously to a twin belt continuous caster, the molten aluminum alloy being dispensed at a temperature of about 600° C. to about 800° C.;

(b) continuous casting the molten aluminum alloy with the twin belt caster into aluminum alloy strip material wherein the strip material has a gage thickness of about 10 millimeters to about 16 millimeters and the strip material exits the caster at a temperature of about 400° C. to about 600° C.;

(c) thinning the aluminum alloy strip material to form aluminum alloy sheet material to a desired gage thickness of from about 2 millimeters to about 6 millimeters;

(d) forming the sheet material into one or more aluminum alloy tubes while the sheet material has the same desired gage thickness as when it was formed in step (c);

(e) hydroforming the one or more aluminum alloy tubes into the tubular automotive vehicle structure, the tubular structure having at least one hydroformed contour wherein the structure is a member of a frame of an automotive vehicle.

2. A process as in claim 1 wherein the automotive vehicle structure is a member of a vehicle frame.

3. A process as in claim 1 wherein the automotive vehicle structure is a side rail of the automotive vehicle frame.

4. A process as in claim 1 wherein the aluminum alloy includes about 2.85 weight percent magnesium.

5. A process as in claim 4 wherein the aluminum alloy is substantially AA5754-CC.

6. A process of forming an aluminum alloy automotive vehicle structure, comprising the steps of:

(a) providing a molten aluminum alloy by heating and melting ingots in a furnace system, the furnace system including a dispenser wherein;

i) the alloy includes about 0.05 to about 2.0 weight percent silicon, up to about 0,60 weight percent iron, about 0.01 to about 4.0 weight percent copper, up to about 1.0 weight percent manganese, about 0.10 to about 6.0 weight percent magnesium and up to about 0.50 weight percent chromium; and ii) the molten aluminum alloy is dispensed substantially continuously from the dispenser to a twin belt continuous caster, the molten aluminum alloy being dispensed at a temperature of about 600° C. to about 800° C.;

(b) continuous casting the molten aluminum alloy into aluminum alloy strip material wherein;

i) the molten aluminum alloy is received between a first belt and a second belt of a twin belt caster and is continuously advanced as the molten aluminum alloy cools and hardens to form the aluminum alloy strip material;

ii) the strip material has a gage thickness of about 8 millimeters to about 18 millimeters; and iii) the strip material exits the caster at a temperature of about 400° C. to about 600° C.;

(c) thinning the aluminum alloy strip material to form aluminum alloy sheet material to a desired gage thickness wherein;

i) the desired gage thickness is from about 2 millimeters to about 8 millimeters; and ii) the aluminum alloy strip material is continuously fed to a rolling system having at least two pair of opposing rollers that compress the strip material to the desired gage thickness;

(d) forming the sheet material into one or more aluminum alloy tubes wherein;

i) the sheet material is cut into elongated strips with opposing side edges;

ii) the elongated strips are fed to a tube rolling mill to form the elongated strips into a tubular configuration with the opposing side edges adjacent each other;

iii) the opposing side edges are induction welded together for maintaining the tubular configuration; and iv) the strips are cut while in the tubular configuration or prior to forming the tubular configuration to a desired length of the one or more tubes; and (e) hydroforming the one or more aluminum alloy tubes into a tubular automotive vehicle structure having at least one hydroformed contour wherein the one or more tubes have substantially the same desired gage thickness as in step (c).

7. A process as in claim 6 wherein the automotive vehicle structure is a member of a vehicle frame.

8. A process as in claim 6 wherein the automotive vehicle structure is a side rail of the automotive vehicle frame.

9. A process as in claim 6 wherein the aluminum alloy includes about 2.85 weight percent magnesium.

10. A process as in claim 9 wherein the aluminum alloy is substantially M5754-CC.

11. A process of forming an aluminum alloy automotive vehicle structure, comprising the steps of:

(a) providing a molten aluminum alloy by heating and melting ingots in a furnace system, the furnace system including a dispenser wherein;

i) the alloy includes about 0.05 to about 2.0 weight percent silicon, up to about 0.60 weight percent iron, about 0.01 to about 4.0 weight percent copper, up to about 1.0 weight percent manganese, about 0.10 to about 6.0 weight percent magnesium and up to about 0.50 weight percent chromium; and ii) the molten aluminum alloy is dispensed substantially continuously from the dispenser to a twin belt continuous caster, the molten aluminum alloy being dispensed at a temperature of about 600° C. to about 800° C.;

(b) continuous casting the molten aluminum alloy into aluminum alloy strip material wherein;

i) the molten aluminum alloy is received between a first belt and a second belt of a twin belt caster and is continuously advanced as the molten aluminum alloy cools and hardens to form aluminum alloy strip material;

ii) the strip material has a gage thickness of about 8 millimeters to about 18 millimeters and a width of about 58 inches; and iii) the strip material exits the caster at a temperature of about 400° C. to about 600° C.;

(c) thinning the aluminum alloy strip material to form aluminum alloy sheet material to a desired gage thickness wherein;

i) the desired gage thickness is from about 2 millimeters to about 8 millimeters; and ii) the aluminum alloy strip material is continuously fed to a rolling system having at least two pair of opposing rollers that compress the strip material to the desired gage thickness;

(d) rolling the sheet material into coils for easing the transportation of the sheet material;

(e) forming the sheet material into one or more aluminum alloy tubes wherein;

i) the sheet material is cut into elongated strips with opposing side edges;

ii) the elongated strips are fed to a tube rolling mill to form the elongated strips into a tubular configuration with the opposing side edges adjacent each other;

iii) the opposing side edges are induction welded together for maintaining the tubular configuration; and iv) the strips are cut while in the tubular configuration or prior to forming the tubular configuration to a desired length of the one or more tubes; and (f) hydroforming the one or more aluminum alloy tubes into a tubular automotive vehicle structure having at least one hydroformed contour wherein;

i) the tubes are deformed to a configuration having the general shape of the vehicle structure for placement into a die;

ii) ends of the tube are sealed shut; and iii) the tubes are placed in the die and are filled with a liquid that pressurizes an interior portion of the tubes such that the tubes assume the shape of the die thereby forming the at least one hydroformed contour.

* * * * *